US005304977A

United States Patent [19]

Caddock, Jr.

[11] Patent Number: 5,304,977

[45] Date of Patent: Apr. 19, 1994

[54] FILM-TYPE POWER RESISTOR COMBINATION WITH ANCHORED EXPOSED SUBSTRATE/HEATSINK

[75] Inventor: Richard E. Caddock, Jr., Winchester, Oreg.

[73] Assignee: Caddock Electronics, Inc., Riverside, Calif.

[21] Appl. No.: 863,851

[22] Filed: Apr. 6, 1992

Related U.S. Application Data

[63] Continuation-in-part of Ser. No. 758,599, Sep. 12, 1991, abandoned.

[51] Int. Cl.[5] ..... H01C 1/034

[52] U.S. Cl. ..... 338/275; 338/51; 338/253; 338/159; 338/312; 338/274; 338/332; 338/273

[58] Field of Search ..... 338/278, 312, 253, 258, 338/273-274, 51, 329, 315, 226, 322, 324, 159

[56] References Cited

U.S. PATENT DOCUMENTS

| | | | |
|---|---|---|---|
| Re. 28,597 | 10/1975 | Horii et al. | 338/275 X |
| 3,638,161 | 1/1972 | Dumas | 338/256 |
| 3,649,944 | 3/1972 | Caddock | 338/260 |
| 3,722,085 | 3/1973 | Caddock | 29/620 |
| 4,643,497 | 2/1987 | Oelsch | 338/322 |
| 4,788,524 | 11/1988 | Ozaki | 338/324 X |
| 5,119,063 | 6/1992 | Nonnenmacher et al. | 338/159 |

OTHER PUBLICATIONS

Caddock Electronics, Inc. General Catalog 23rd Edition, 1989, pp. 17-21.

Motorola Catalog: 1989 FULL PAK Power Semiconductors for Isolated Package Applications.

Pp. 6-18 and 1-134 of Motorola Catalog entitled BiPolar Power Transitor and Thyristor Data.

Data Sheet No. PD-2.068A from International Rectifier 1985 Product Guide and Specification Databook.

*Primary Examiner*—Marvin M. Lateef

*Attorney, Agent, or Firm*—Richard L. Gausewitz

[57] ABSTRACT

The film-type electrical power resistor includes a flat ceramic chip on the upper surface of which is screen-printed a resistive film. Terminals (leads) are mechanically and electrically connected to the upper chip surface, the terminals being such that the chip may be positioned by the terminals in a predetermined position in a mold cavity during manufacture of the resistor—prior to introduction of synthetic resin. The synthetic resin forms a molded electrically insulating body that embeds the portions of the terminals that are relatively near the chip, and also embeds the upper portion of the chip, but does not embed the bottom surface of the chip. The relationships are such that the lower chip surface may be engaged flatwise with a flat region of a chassis or heatsink. Accordingly, the chip is a substrate for the film, a heatsink for the film, an insulator maintaining the film electrically insulated from the chassis, and a spacer maintaining the terminals spaced from the chassis. The resistor does not contain any metal layer that is either in an electric circuit or projects outwardly relative to the edges of the chip. To permit assembly of the resistor with a chassis or heatsink, a bolthole extends through the body at a region outside the chip.

17 Claims, 3 Drawing Sheets

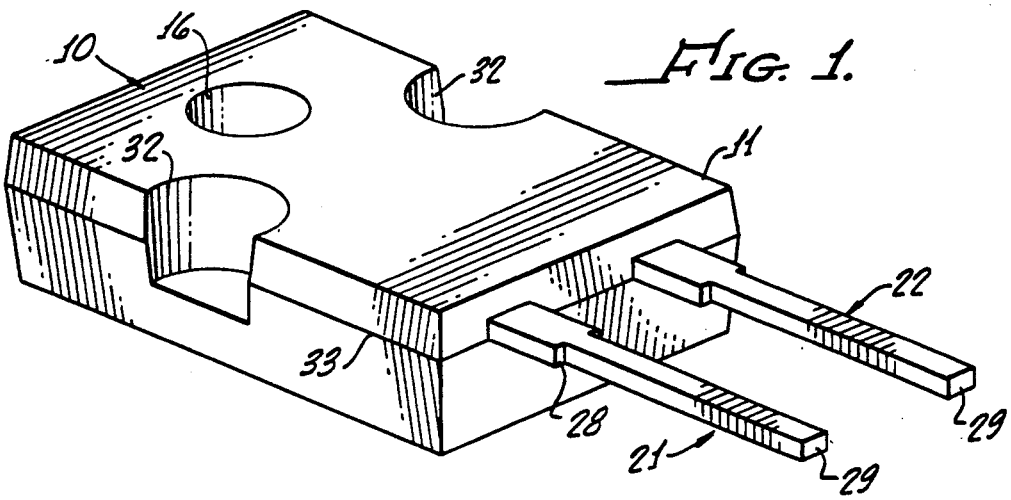
FIG. 1.
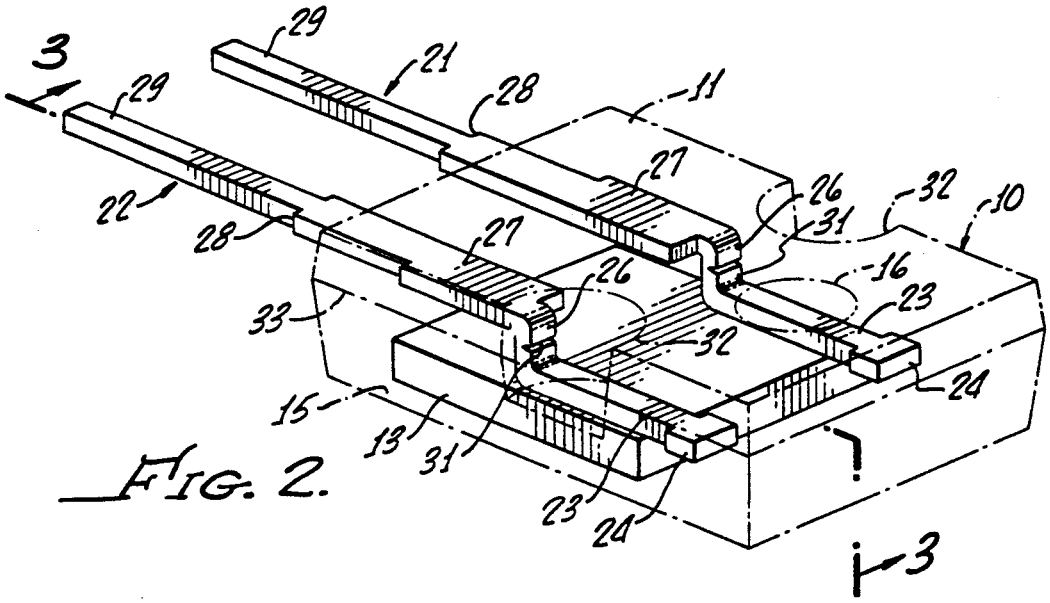
FIG. 2.
FIG. 3.
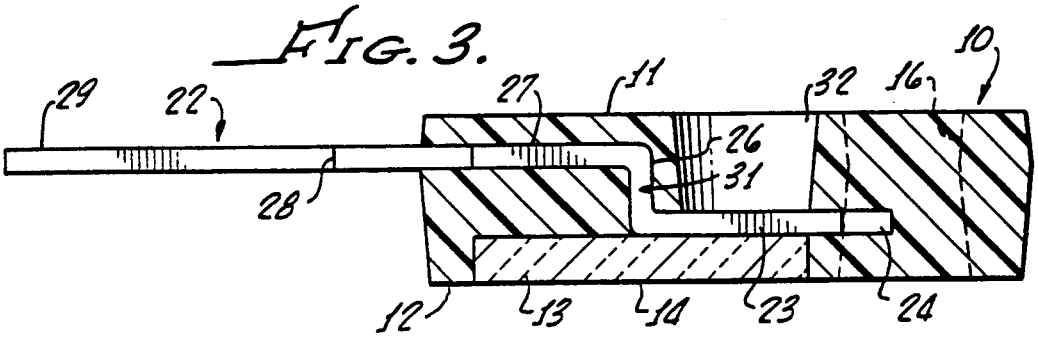

FILM-TYPE POWER RESISTOR COMBINATION WITH ANCHORED EXPOSED SUBSTRATE/HEATSINK

CROSS REFERENCE TO RELATED APPLICATION

This is a continuation-in-part of application Ser. No. 758,599, filed Sep. 12, 1991, abandoned for Film-Type Power Resistor Combination with Anchored Exposed Substrate/Heatsink.

BACKGROUND OF THE INVENTION

The flat substrates employed in many film-type power resistors are, preferably, thin—being made of a ceramic. It has long been known in the prior art to embed such a substrate, having a resistive film thereon, in a body of synthetic resin, with no thought of any heatsink action. Prior-art power resistors of the type indicated rely, for cooling, solely on passage of air over the synthetic resin body, and on conduction of heat through the leads that are connected to the resistive film. Such prior-art resistors have low power ratings. For many years, the assignee of the present patent application has made and sold large numbers of flat film-type power resistors that are fully encapsulated in a silicone molding compound. These resistors are free-standing, mounted upright (like tombstones) directly on the circuit board, and not mounted in engagement with any chassis (heatsink). Thus, with such resistors, there is no danger of shorting through or arcing to the chassis. such free-standing prior-art power resistor is shown in FIG. 8. A transfer-molded silicone body is shown in phantom lines. An aluminum oxide ceramic chip is the back element (in the drawing), and has a back surface spaced from the back surface of the silicone body. On the front of the chip are screen-printed metalization edge pads, resistive film and glass. The indicated leads are soldered to the edge pads.

SUMMARY OF THE INVENTION

According to one aspect of the present invention, the ceramic substrate or chip is so incorporated in the synthetic resin body that the bottom substrate surface is not embedded in resin but is instead exposed. This bottom surface, namely the surface on the side of the substrate remote from the resistive film, is caused to be engaged flatwise with a chassis (external heatsink). A bolthole is provided through the synthetic resin body to receive a bolt which firmly secures the body to the chassis and thus holds the bottom substrate surface in heat-transfer relationship with the chassis.

In accordance with another aspect of the invention, extended terminals (leads) are embedded in the synthetic resin and are mechanically and electrically connected to the upper side of the chip or substrate. The leads are so constructed as to aid substantially in anchoring the substrate in the resin despite the fact that the bottom substrate surface is exposed. The leads are adapted to permit some angular movement of the substrate in the mold, so that the bottom substrate surface is substantially always fully exposed and ready for flatwise engagement with the chassis.

BRIEF DESCRIPTION OF THE DRAWINGS

FIG. 1 is an isometric view of a film-type power resistor incorporating the present invention;

FIG. 2 is another isometric view thereof, as seen from the other end, and with the synthetic resin body shown in phantom lines so as to reveal certain internal components of the resistor;

FIG. 3 is a longitudinal sectional view on line 3—3 of FIG. 2;

DETAILED DESCRIPTION OF THE PREFERRED EMBODIMENT

Figure 4:
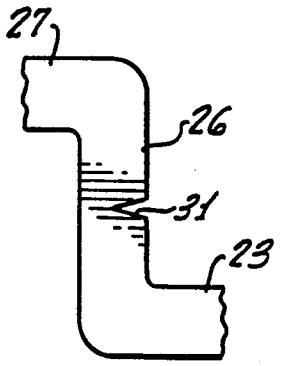
FIG. 4 is an enlarged fragmentary view of the readily-bendable portion of a terminal or lead.

Referring to FIG. 1, the resistor comprises an elongate rectangular synthetic resin body 10 having a flat upper surface 11 that is substantially parallel to a flat lower or bottom surface 12 (FIG. 3). Lower surface 12 of the resin body is not continuous but instead has provided therein, in "framed" relationship by lower regions of the resin body, a flat substrate or chip 13. Substrate 13 has substantially parallel top and bottom surfaces, the bottom surface being denoted by the reference numeral 14 and being flush with surrounding regions of the lower surface 12 of body 10.

Substrate 13 is therefore embedded in and encompassed on all sides by the resin body 10, except for bottom substrate surface 14 that is adapted to engage a chassis or heatsink in flatwise heat-transfer relationship. The substrate or chip 13 is relatively close to one end of body 10 (the left end in FIGS. 2 and 3) and is spaced a substantial distance from the other end thereof (the right end in such figures). Bolthole 16 is extended through body 10 with its axis perpendicular to such body and to substrate 13, in such relationship that no part of the bolthole is close to the substrate. Bolthole 16 is adapted to receive a bolt (not shown) that extends through a corresponding hole in a flat metal chassis region (not shown) so as to firmly clamp bottom surface 14 of substrate 13 against the flat chassis region in heat-transfer relationship.

Although substrate 13 is not spaced equal distances from the ends of body 10, it is spaced equal distances from the sides of such body. One such side space is shown at 15 in FIG. 2, being the mirror image of the side space (not shown) that is parallel thereto.

As described subsequently relative to FIGS. 5-7, the upper surface of substrate 13 has combination termination traces and pads 17 thereon, also has resistive film 18 thereon, and also has a protective coating 19 thereon. Furthermore, terminals or leads are secured mechanically and electrically to coatings on the upper surface of the substrate, as next described. It is emphasized that the substrate 13 accordingly acts not only as a substrate but as an electrical insulator or dielectric element, and further acts as a heatsink. It further acts as a spacer to ensure that no portions of the leads come closer to the bottom surface of the resistor element than is the top surface of the substrate/electrical insulator/heatsink/-spacer 13.

Although element 13 is a good electrical insulator, it is selected to have relatively high thermal conductivity for a nonmetal element. The preferred substance for substrate or chip 13 is aluminum oxide ceramic. Less preferred materials are beryllium oxide and aluminum nitride.

Elongate metal terminals or leads 21,22 are provided as best shown in FIG. 2, being mirror images of each other about a vertical plane containing the longitudinal axis of body 10. The terminals are preferably bendable metal stampings.

Each terminal 21,22 has an elongate narrow end section 23 the length of which is more than half the length of ceramic 13, and which has a tab 24 on its extreme inner end. The narrow end sections 23 of the terminals are electrically and mechanically connected to the combination traces and pads 17, in such relationship that the extreme inner ends of elements 23, including tabs 24, are not directly above the substrate but instead are cantilevered therefrom as best shown in FIGS. 2, 3 and 7.

At the portions of end sections 23 remote from tabs 24, the terminals 21,22 have integral riser portions 26 that extend upwardly for a considerable distance from ceramic 13 but are still spaced——at their upper ends——a substantial distance below upper surface 11 of body 10. The riser portions 26, in turn, connect to sections 27 that are parallel to the narrow sections 23 but in a substantially higher plane. Sections 27 extend outwardly from body 10 to shoulders 28. At such shoulders, the terminals narrow to provide prongs 29 for connection to conventional terminals or sockets.

As shown in FIGS. 2-4, risers 26 are either formed relatively thin or have the illustrated notches 31 provided therein so that the risers are relatively readily bendable. This aids, as next described, in causing the ceramic chip element 13 to lie flat on the bottom of mold cavity during transfer molding of the body 10. Accordingly, and as shown in FIG. 3, the bottom surface 14 of the element 13 is flush with bottom surface 12 of the body 10 for effective high thermal-conductivity flatwise engagement with a flat chassis region.

The result is a resistor-chassis combination in which the resistor has a low cost but high power rating. There is nothing between the resistive film 18 and the chassis except the ceramic chip 13 that is itself part of the film-type resistor, and except (in many cases) a thermal grease that is applied by the customer. On the other hand, the present resistor is less rugged than are power resistors wherein the bottom surface is metal or high-thermal conductivity epoxy.

To mold the present resistor, the below-described subcombination comprising the ceramic element 13, terminals 21,22, etc., is disposed relative to the bottom section of a mold (not shown) in such manner that the undersides of terminals 21,22 rest on such bottom section in a predetermined position at a cavity edge, the terminals being suitably held down. The ceramic chip 13 is thus positioned in the bottom portion of the mold cavity at a predetermined location. The riser 26 and other parts are so correlated in size with the mold cavity that the bottom chip surface 14 rests on the bottom cavity wall when the terminals rest on the mold section edge.

The upper portion of the mold incorporates pins adapted to engage the upper surfaces of narrow end sections 23 of terminals 21,22, thus forcing such end sections as well as the underlying ceramic element down until bottom surface 14 of the ceramic is in close flatwise engagement with the bottom wall of the mold cavity. Because of the presence of the thin regions or notches 31 in risers 26, the terminals 21,22 can bend in response to mold closing, thus facilitating or making possible the close flatwise engagement between ceramic surface 14 and the bottom cavity wall in the vast majority of instances.

Accordingly, the hot synthetic resin, which is preferably heated epoxy powder, does not penetrate between ceramic surface 14 and the mold wall during the transfer molding operation. Instead, it effectively surrounds or frames the edges of the ceramic chip as well as embedding all portions of terminals 21,22 except prongs 29 and the terminal regions adjacent shoulders 28.

Because of the presence of the tabs 24 and adjacent terminal regions, and because of the presence of the terminal sections 27, and because of the fact that terminal sections 23 are mechanically connected to chip 13 as described below, the chip 13 is effectively anchored in the synthetic resin body 10.

The indicated pins in the upper portion of the mold leave notches or recesses 32 in the resin body at the corners thereof, as best shown in FIG. 1.

The parting line between the upper and lower mold sections is shown at 33, being in the same plane as that of the lower surfaces of terminal portions 27 and 29.

Figure 5:
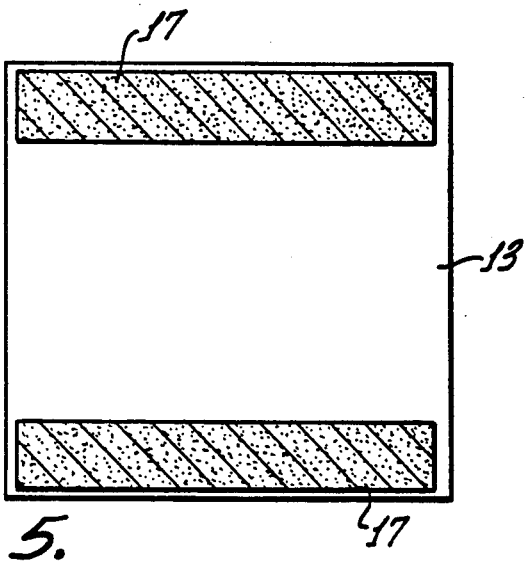
FIG. 5 is a top plan view of the substrate, after combination trace and pad films have been applied thereto.

Referring next to FIG. 5, the ceramic chip 13 has applied to the upper surface thereof two combination traces and pads 17. The traces and pads are elongate rectangles, are preferably applied by screen-printing, and lie generally along opposite edge portions of the chip 13 in parallel relationship to each other. The combination traces and pads 17 are adapted to——and later do——extend longitudinally of the resistor body 10. The material forming the combination traces and pads 17 is beryllium oxide and aluminum nitride. Following such screen-printing, the ceramic element is fired.

Figure 6:
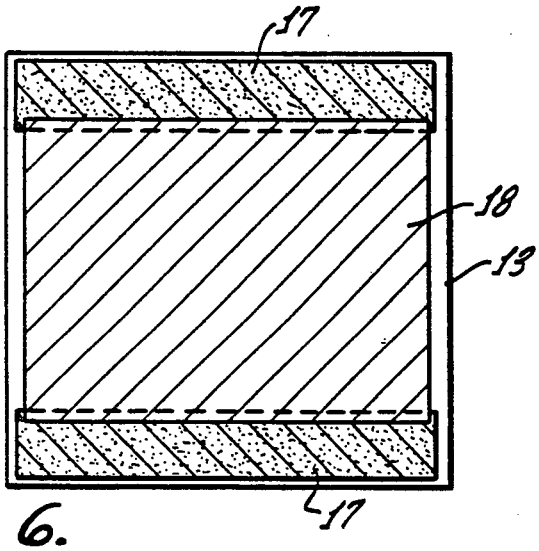
FIG. 6 is a view corresponding to FIG. 5 but showing resistive film applied to the substrate or chip and over edge regions of the trace and pad films.
Figure 7:
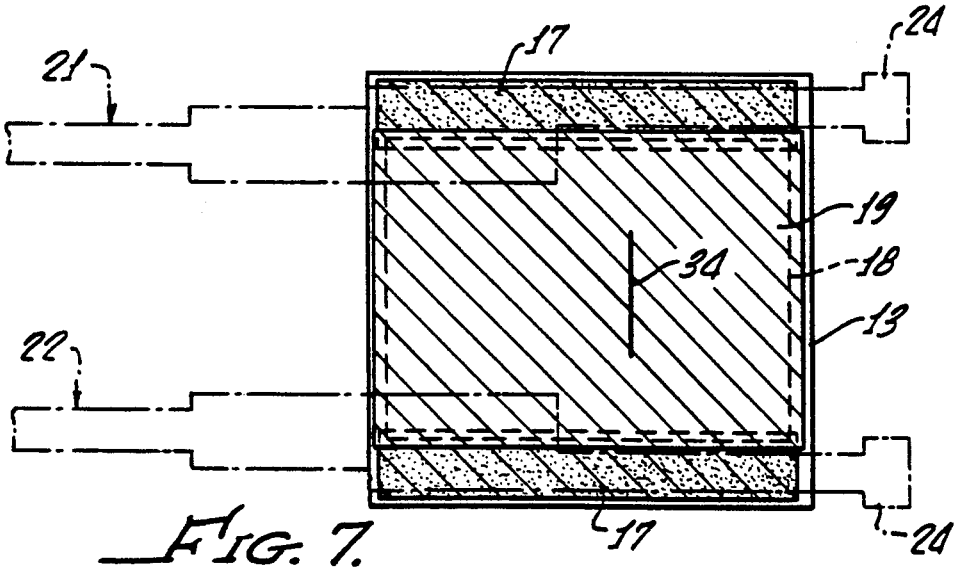
FIG. 7 is a view corresponding to FIG. 6 and also showing a protective coating applied over the resistive film, and further showing in phantom lines the terminals associated with the combination trace and pad films and thus with the resistive film and the substrate.
Figure 8:
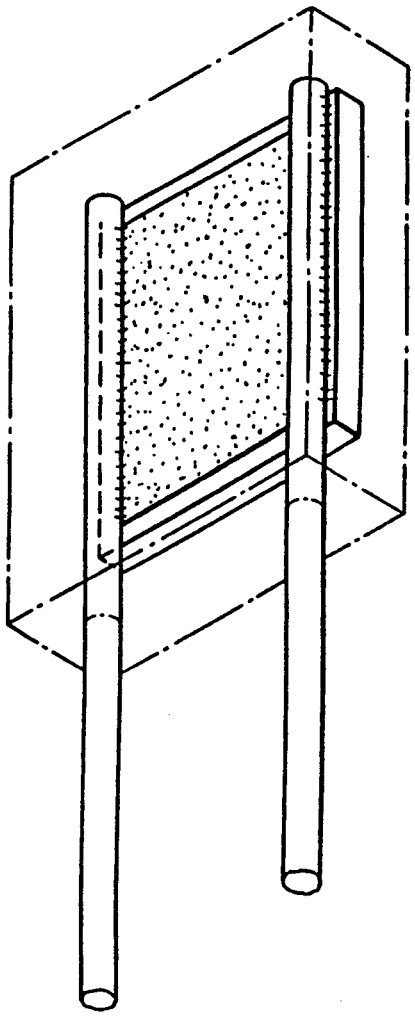
FIG. 8. (PRIOR ART)
FIG. 8 is an isometric view showing prior art only.

Referring next to FIG. 6, a thick film 18 of resistive material is screen-printed onto ceramic element 13. The edge regions (top and bottom in FIG. 6) of resistive film 18 overlap somewhat the combination traces and pads 17, as illustrated. After being screen-printed onto the substrate, the ceramic element is again fired. The preferred resistive material comprises electrically-conductive complex metal oxides in a glass matrix, and is fired at a temperature in excess of 800 degrees C.

There is then screen-printed onto the entire upper surface of resistive film 18, and for slight distances past such film, a protective coating 19 preferably comprising glass. A relatively low melting point glass frit is screen-printed onto the substrate as stated, and is fired at a temperature of about 500 degrees C. The major difference between the firing temperature of the resistive film 18, and that of the glass 19, is such that firing of the glass does not adversely affect the resistive film 18. The protective coating 19 prevents the resin of body 10 from adversely affecting resistive film 18. Such resin of body 10 is preferably high thermal conductivity epoxy resin.

There is then screen-printed onto those portions of combination traces and pads 17 not covered by glass 19 a solder composition. Alternatively, the solder is applied by dipping. This composition preferably comprises 96.5% tin and 3.5% silver. Although only a portion of the solder is employed for securing the terminals as next stated, the entire exposed upper surface portions of films 17 are solder coated in order to improve their electrical conductivity.

As the next step, the terminals 21,22 are clamped to substrate 13, with the sections 23 (FIG. 2) of the terminals firmly seated on the above-indicated solder (not shown) that was applied to combination traces and pads 17. Then, baking is effected in order to melt the solder and thereby secure the terminals to the coated ceramic element 13. The terminals are thus mechanically and electrically connected to such element. Thereafter, molding is effected as stated relative to FIGS. 1–3.

Before molding takes place, the resistor is trimmed by laser scribing a slot or line 34 of appropriate length and width to achieve the desired resistance value.

Stated more definitely, slot 34 is cut through the resistive film 18, and is made progressively wider until the resistance value of the resistor is as desired.

It is emphasized that slot 34 is parallel to the direction of current flow. The termination traces 17 are parallel to each other, and slot 34 is made perpendicular to such traces. Current flows directly between the termination traces and perpendicular to them. Accordingly, the direction of current flow through the resistive film is parallel to slot 34.

By making slot 34 parallel to such current flow, important benefits are achieved vis-a-vis obtaining uniformly high current density, and high power-handling capability.

As a specific example, each terminal 21,22 is 0.020 inch thick. The sections 23 are 0.035 inch wide. The height of each riser 26, from the bottom surface of section 23 to the bottom surface of section 27, is 0.060 inch. The molded body 10 is 0.150 inch thick, with the parting line 33 being 0.090 inch from bottom surface 12. The ceramic chip 13 is about 0.030 inch thick, 0.32 inch wide and 0.35 inch long. Body 10 is 0.410 inch wide and 0.640 inch long.

The foregoing detailed description is to be clearly understood as given by way of illustration and example only, the spirit and scope of this invention being limited solely by the appended claims.

What is claimed is:

1. A film-type electrical power resistor, which comprises:

(a) a flat nonmetal chip having an upper surface and a lower surface, having a high dielectric strength, and having relatively high thermal conductivity for a nonmetal, (b) a resistive film applied to said upper surface of said chip, (c) terminals connected mechanically to said upper surface of said chip and connected electrically to said resistive film, said terminals being such that said chip with said film thereon may be positioned by said terminals in a predetermined position in a mold cavity, during manufacture of the power resistor, prior to introduction of synthetic resin into said mold cavity, (d) a molded electrically insulating body embedding those portions of said terminals that are relatively adjacent said chip, and also embedding only the upper portion and edge portions of said chip, said molded body not having any mold cup therearound.

said lower chip surface and said body being so related to each other that said lower surface may be engaged in flatwise relationship to a flat region of a chassis or heatsink.

said chip serving as a substrate for said film, as a heatsink for heat generated by said film, as an insulator maintaining said film electrically insulated from said chassis, and as a spacer maintaining said terminals spaced from said chassis.

said resistor not containing any metal layer that is either in an electric circuit or projects outwardly relative to the edges of said chip, and (e) a bolthole extended through said body for clamping of said resistor in effective heat-transfer relationship to said flat region of said chassis or heatsink.

2. The invention as claimed in claim 1, in which said chip is a ceramic.

3. The invention as claimed in claim 2, in which said ceramic is selected from a group consisting of aluminum oxide, beryllium oxide and aluminum nitride.

4. The invention as claimed in claim 3, in which said ceramic is aluminum oxide.

5. The invention as claimed in claim 1, in which said body is molded of an epoxy.

6. The invention as claimed in claim 1, in which said resistive film is a thick film which has been screen-printed onto the upper surface of said chip.

7. The invention as claimed in claim 1, in which said bolthole does not pass through said chip.

8. A film-type power resistor, which comprises:

(a) a flat substrate having substantially parallel upper and lower surfaces, said substrate being formed of a substance that is electrically insulating and has substantial thermal conductivity, (b) a resistive film applied to said upper surface, (c) elongate terminal means disposed above said resistive film, said terminal means being mechanically connected to said upper surface of said substrate and being electrically connected to said resistive film, said terminal means extending across said substrate, said terminal means having one portion disposed outboard of one edge of said substrate and having another portion disposed outboard of an opposite edge of said substrate, said terminal means being such that said substrate with said film thereon may be positioned by said terminal means in a predetermined position in a mold cavity, during manufacture of the power resistor, prior to introduction of synthetic resin into said mold cavity, (d) a molded synthetic resin body embedding said resistive film and only the upper and edge portions of said substrate, said molded body not having any mold cup therearound, said synthetic resin body also embedding at least said one outboard portion of said terminal means, and also embedding that part of said other outboard portion of said terminal means that is adjacent said opposite edge of said substrate, but not embedding the part of said other outboard portion of said terminal means that is remote from said opposite edge, said terminal means holding said substrate in position in said body, said resistor not containing any metal layer that is either in an electric circuit or projects outwardly relative to the edges of said substrate, and (e) a bolthole extended through said body for clamping of said resistor in effective heat-transfer relationship to said flat region of said chassis or heatsink.

9. The invention as claimed in claim 8, in which said terminal means has tabs forming part of said one portion, to increase the strength of embedment in said body.

10. The invention as claimed in claim 8, in which said terminal means comprises two elongate parallel terminals each having one part thereof seated on said substrate, being the part mechanically connected to said substrate.

11. The invention as claimed in claim 10, in which said one part and said other part of each terminal are connected to each other by a riser, said riser being readily bendable prior to molding of said body, and in which the bottom surface of said substrate is not embedded in said body but is instead exposed for flatwise engagement with a flat region of a chassis.

12. A low-cost high-power film-type resistor, which comprises:

(a) a flat chip formed of ceramic,
said chip having substantially parallel upper and lower surfaces, (b) first and second trace and pad films screen-printed onto said upper surface, (c) a thick-film resistive film screen-printed onto said upper surface and electrically in contact with said trace and pad films, (d) first and second terminals having portions conductively bonded to said trace and pad films,
said terminals also having outer end portions extending away from at least one edge of said chip to regions relatively remote from said chip,
said terminals being such that said chip with said film thereon may be positioned by said terminals in a predetermined position in a mold cavity, during manufacture of the power resistor, prior to introduction of synthetic resin into said mold cavity, (e) a molded body of synthetic resin embedding said films and said upper surface of said chip as well as said edge portions of said chip,
said resin body not having any mold cup therearound,
said resin body also embedding said terminals except at said regions of said terminals relatively remote from said chip,
said resin body having bottom portions that at least substantially encompass said edges of said chip,
said bottom portions of said resin body having bottom surfaces that are substantially flush with said lower surface of said chip, said lower surface of said chip not being coated by said resin body, and (f) a bolthole provided through the other end portion of said body for use in bolting said body to a flat portion of a chassis or heatsink.
said lower surface of said chip then being in flatwise heat-transfer engagement with said flat portion of a chassis or heatsink,
said resistor not containing any metal layer that is either in an electric circuit or projects outwardly relative to the edges of said chip.

13. The invention as claimed in claim 12, in which said body is rectangular and elongate and has an upper surface generally parallel to said lower surface of said chip, and in which said chip is generally square and is relatively near one end of said body, 14. The invention as claimed in claim 12, in which a trimming slot is provided through said resistive film, in which said termination traces are substantially parallel to each other, and in which said trimming slot is substantially perpendicular to said termination traces, whereby said trimming slot is parallel to the direction of current flow through said resistive film between said termination traces, and in which there is no substantial trimming slot or slot portion that is not substantially perpendicular to said termination traces.

15. The invention as claimed in claim 14, in which a barrier coating is provided over said resistive film, between it and said synthetic resin body, to prevent said synthetic resin body from adversely affecting said resistive film.

16. The invention as claimed in claim 15, in which said synthetic resin body is high thermal-conductivity synthetic resin.

17. The invention as claimed in claim 16, in which said barrier coating is glass having a firing temperature much lower than that of said resistive film.

* * * * *